US009098031B2

(12) United States Patent
Cao et al.

(10) Patent No.: US 9,098,031 B2
(45) Date of Patent: Aug. 4, 2015

(54) NARROW MEDIA THROUGHPUT CONTROL USING TEMPERATURE FEEDBACK

(75) Inventors: Jichang Cao, Lexington, KY (US); Michael Duane Donovan, Lexington, KY (US); Douglas Campbell Hamilton, Lexington, KY (US)

(73) Assignee: Lexmark International, Inc. KY (US)

( * ) Notice: Subject to any disclaimer, the term of this patent is extended or adjusted under 35 U.S.C. 154(b) by 138 days.

(21) Appl. No.: 13/554,749

(22) Filed: Jul. 20, 2012

(65) Prior Publication Data

US 2013/0259507 A1 Oct. 3, 2013

Related U.S. Application Data

(60) Provisional application No. 61/618,776, filed on Mar. 31, 2012.

(51) Int. Cl.
*G03G 15/20* (2006.01)

(52) U.S. Cl.
CPC .. *G03G 15/2042* (2013.01); *G03G 2215/00734* (2013.01); *G03G 2215/00751* (2013.01); *G03G 2215/00945* (2013.01)

(58) Field of Classification Search
USPC ..... 399/45, 69, 122, 328, 329, 334
See application file for complete search history.

(56) References Cited

U.S. PATENT DOCUMENTS

| | | | | |
|---|---|---|---|---|
| 7,098,430 | B2 * | 8/2006 | Kondo et al. | 219/619 |
| 7,561,816 | B2 * | 7/2009 | Asakura et al. | 399/69 |
| 7,933,530 | B2 * | 4/2011 | Cook et al. | 399/69 |
| 2004/0223777 | A1 * | 11/2004 | Cao et al. | 399/68 |
| 2006/0088329 | A1 * | 4/2006 | Suzuki et al. | 399/69 |
| 2008/0273890 | A1 * | 11/2008 | Furuyama | 399/69 |
| 2009/0245835 | A1 | 10/2009 | Campbell et al. | |
| 2009/0257770 | A1 * | 10/2009 | Miyazaki | 399/69 |
| 2011/0097663 | A1 * | 4/2011 | Campbell et al. | 430/124.1 |
| 2011/0142473 | A1 * | 6/2011 | Tanaka | 399/69 |
| 2013/0188977 | A1 * | 7/2013 | Hase et al. | 399/69 |

* cited by examiner

*Primary Examiner* — Francis Gray

(57) ABSTRACT

A printer is provided having a fuser assembly having a belt, a heater to heat the belt, a backup roll positioned to engage the belt thereby defining a fusing nip with the belt, a main temperature sensor associated with the heat transfer member, the first temperature sensor associated with the backup roll for sensing a temperature of a portion of the backup roll, the second temperature sensor associated with a distal end region of the heat transfer member for sensing the temperature of the distal end region. A controller is coupled to the fuser assembly for controlling a throughput of the printer based on at least one of the backup roll temperature and the temperature at the distal end region of the heater.

29 Claims, 7 Drawing Sheets

| Simplex Gap Table | | | | | | |
|---|---|---|---|---|---|---|
| **Media Type** | **Media Length (mm)** | **Gap 1** | **Gap 2** | **Gap 3** | **Gap 4** | **Gap 5** |
| A6 | 148 | 400 | 900 | 1400 | 1750 | 2000 |
| A5 | 210 | 500 | 900 | 1500 | 1800 | 2100 |
| Executive | 266.7 | 500 | 1000 | 1500 | 2250 | 3000 |
| Letter | 279.4 | 500 | 1000 | 1650 | 2325 | 3000 |
| A4 | 297 | 500 | 1000 | 1900 | 2450 | 3000 |
| Legal | 355.6 | 600 | 1200 | 2000 | 3000 | 4000 |

| Duplex Gap Table | | | | | | |
|---|---|---|---|---|---|---|
| **Media Type** | **Media Length (mm)** | **Gap 1** | **Gap 2** | **Gap 3** | **Gap 4** | **Gap 5** |
| A6 | 148 | 600 | 1200 | 2000 | 2500 | 3000 |
| A5 | 210 | 800 | 1600 | 3000 | 4250 | 5500 |
| Executive | 266.7 | 800 | 1600 | 3000 | 5000 | 6000 |
| Letter | 279.4 | 1000 | 2000 | 3500 | 5250 | 7000 |
| A4 | 297 | 1000 | 2000 | 4000 | 5500 | 7000 |
| Legal | 355.6 | 1000 | 2000 | 5000 | 6500 | 8000 |

*FIG. 4*

NARROW MEDIA THROUGHPUT CONTROL USING TEMPERATURE FEEDBACK

CROSS REFERENCES TO RELATED APPLICATIONS

Pursuant to 35 U.S.C. §119, this application claims the benefit of the earlier filing date of Provisional Application Ser. No. 61/618,776, filed Mar. 31, 2012, entitled "Narrow Media Throughput Control Using Temperature Feedback," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present invention relates in general to an electrophotographic imaging apparatus and in particular to an electrophotographic apparatus which controls throughput based on media width using temperature feedback.

2. Description of the Related Art

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a media sheet intended to receive the final image. The toner image is fixed to the media sheet by the application of heat and pressure in a fuser assembly. The fuser assembly may include a heated roll and a backup roll forming a fuser nip through which the media sheet passes. Alternatively, the fuser assembly may include a fuser belt, a heater disposed within the belt around which the belt rotates, and an opposing backup member, such as a backup roll.

To be able to fuse the widest media that the laser printer is designed to print, the length of the heating region is typically about 2 mm to about 3 mm longer than the width of the widest media supported by the printer. When a to-be-printed media sheet has a width narrower than the width of the widest media supported by the printer, an overheating problem may occur. Along the portion of the fuser which does not contact the narrow media as the narrow media passes through the fuser, the fluoropolymer coated belt and backup roll of the fuser become very hot and can be damaged due to the high temperature. FIG. 7 below explains the cause of this problem.

FIG. 7 illustrates wide (e.g. Letter) and narrow (e.g., A5) media passing through the fuser nip N of a fuser for a reference edged fed imaging device. Wide media is illustrated in the top part of FIG. 7 and narrow media the bottom part thereof. As is apparent from FIG. 7, a portion of the fuser nip N, Region A, is not contacted by the narrow media. In this case, heat generated by the ceramic heater is not removed from Region A by the narrow media thereby causing an overheating problem. Without heat being removed from Region A, heat generated in Region A continues to heat the coated belt and the backup roll of the fuser. Further, laser printers are designed to have a very small first-copy time such that the thermal mass of the heater and of the coated belt is very small. This causes the amount of heat to build up rapidly in the heater and coated belt in Region A. Furthermore, to achieve a small first-copy time and sufficiently fix the toner to the media sheet, the backup roll surface desirably becomes very hot without conducting heat to the steel or aluminum shaft of the backup roll. This is achieved because the layer surrounding the backup roll shaft is rubber which is a thermal insulator. However, this also means the heat conducted away from the coated belt and heater in Region A by the backup roll is very small. The only other possible mechanism to significantly remove heat from Region A is air convection. Unfortunately, the amount of heat removed by convection is very small for two reasons: 1) in order to meet the very small first-copy time, the heat lost to the air is minimized by enclosing the coated belt and backup roll in plastic covers or a housing to keep the air still; and 2) such plastic covers are designed to act as a heat insulating surface, not a heat conducting device.

Since excessive thermal energy accumulated at the portion of the fuser not contacting the media (hereinafter "non-media portion") during narrow media printing can cause damage to the fusing belt and backup roll, it is desirable to control the amount of thermal energy accumulated at the non-media portion to be below a certain level so that the fuser will not be damaged. To control the thermal energy accumulated at the non-media portion of the fuser, prior attempts both used one or multiple narrow media, mechanical flag sensors to detect media width and user-provided information to determine media length and weight. However, mechanical flag sensors are limited both in precision and being able to detect a number of different media widths, and user-provided information is oftentimes faulty. As a result, prior attempts either made media throughput decisions that were too conservative, thereby leading to reduced performance levels, or caused fuser overheating to occur.

Based on the foregoing, there is a need for an improved system for controlling fusing operations on narrow media sheets in an image forming apparatus.

SUMMARY

Example embodiments overcome the above-identified shortcomings of prior approaches to controlling fuser temperature and thereby satisfy a significant need for a more effective approach to controlling fuser temperatures. Instead of using mechanical narrow media sensors and user-provided media information, example embodiments generally utilize temperature feedback at the non-media portion of fuser and elsewhere to control narrow media throughput.

According to an example embodiment, two temperature sensors are used. A first temperature sensor is placed on or in close proximity to the backup roll at a location to differentiate between narrow media and nearly narrow media. A second temperature sensor is mounted to the fuser heater to detect wide media, which in this case includes Letter and A4 sized paper. The backup roll may combine with the fuser heater and a belt surrounding the fuser heater to form a fuser nip of a fuser assembly.

Accordingly, an imaging apparatus may include the fuser assembly and a controller for controlling media throughput in the imaging apparatus based on at least one of a temperature of the backup roll and a temperature at the distal end region of the fuser heater. Based upon temperatures sensed by the temperature sensors, the controller determines a width of at least one media sheet passing through the fuser assembly and selectively changes media throughput in the imaging apparatus based upon the detected width and the temperatures sensed by the temperature sensors, In an example embodiment, the controller selects at least one temperature set point based upon the determined media width, the at least one temperature set point identifying a temperature level of the fuser heater at which changes to media throughput is initiated. The controller may cause a decrease in print speed upon the temperature of the fuser heater reaching or surpassing a first temperature set point. The controller may cause an increase in an interpage gap between media sheets when the fuser heater reaches or surpasses a second identified temperature set point by an additive gap value that is based upon a temperature of the backup roll as sensed by the first temperature sensor. The controller may thereafter adjust the interpage gap based upon changes in the temperature of the backup roll as sensed by the first temperature sensor. Such adjustment may be performed by monitoring the temperature sensed by the first temperature sensor as each media sheet is fused and adjusting the interpage gap based upon the temperature sensed.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

FIG. 4 depicts tables of added interpage gap amounts based upon media type;

DETAILED DESCRIPTION OF THE INVENTION

Figure 1:
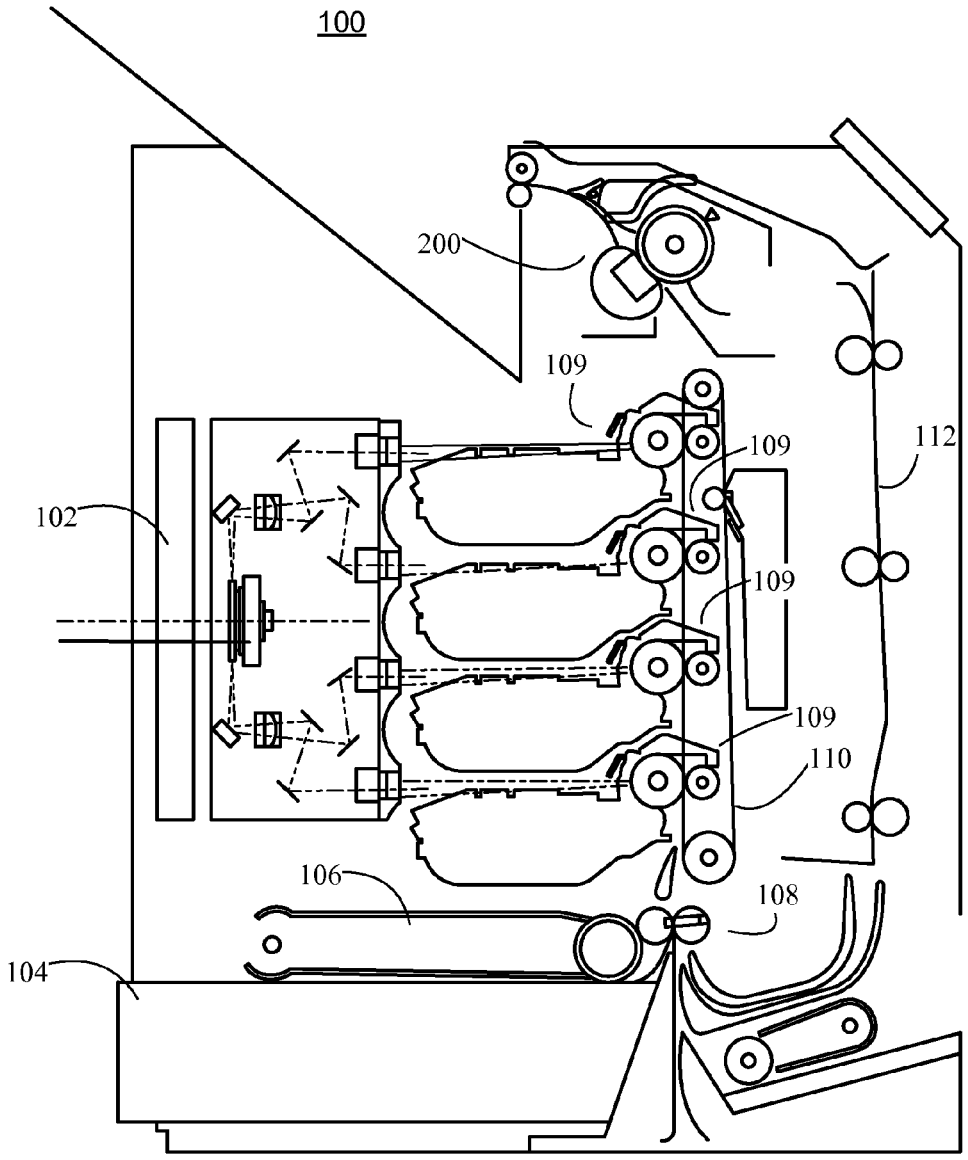
FIG. 1 is a schematic illustration of an electrophotographic printer including a fuser assembly in accordance with an embodiment of the present invention.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Referring now to the drawings and particularly to FIG. 1, there is shown an electrophotographic image forming apparatus in the form of a color laser printer, which is indicated generally by the reference numeral 100. An image to be printed is electronically transmitted to a processor or controller 102 by an external device (not shown) or the image may be stored in a memory associated with the controller 102. The controller 102 includes system memory, one or more processors, and other logic necessary to control the functions of electrophotographic imaging.

In performing a print operation, the controller 102 initiates an imaging operation in which a top media sheet of a stack of media is picked up from a media or storage tray 104 by a pick mechanism 106 and is delivered to a media transport apparatus comprising a pair of aligning rollers 108 and a media transport belt 110 in the illustrated embodiment. The media transport belt 110 carries the media sheet along a media path past each of four image forming stations 109 which apply toner to the media sheet. The image forming apparatus 100 comprises a guide structure defining a reference edge RE (FIG. 3) along an outer edge of a portion of the media path. A side edge of each media sheet engages and moves along the reference edge RE as it travels from the media tray 104 through the aligning rollers 108 to the media transport belt 110. The controller 102 regulates the speed of the media transport belt 110, the pick timing of the pick mechanism 106, and the timing of the image forming stations 109 to control media throughput and to effect proper registration and alignment of the different image planes to the media sheet.

Figure 2:
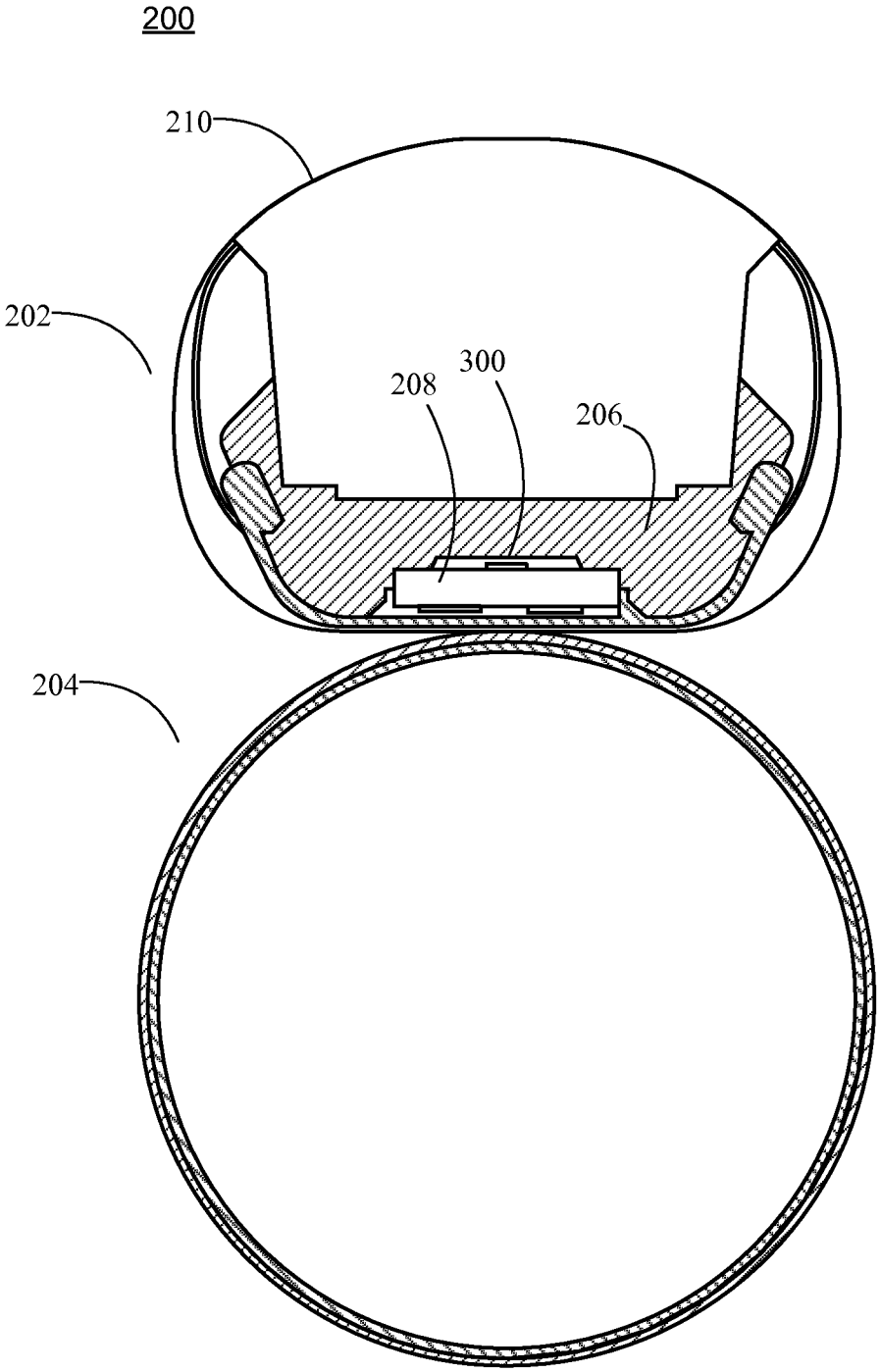
FIG. 2 is a side view, partially in cross section, of the fuser assembly illustrated in FIG. 1.

The media transport belt 110 then carries the media sheet with the unfused toner images superposed thereon further along the media path to a fuser assembly 200. With respect to FIG. 2, the fuser assembly 200 may include a heat transfer member 202 and a backup roll 204 cooperating with the heat transfer member 202 to define a fuser nip for conveying media sheets therebetween. The heat transfer member 202 may include a housing 206, a heater 208 supported on the housing 206, and an endless flexible fuser belt 210 positioned about the housing 206. The heat transfer member 202 and the backup roll 204 may be constructed from the elements and in the manner as the heat transfer member and pressure roller disclosed in U.S. Pat. No. 7,235,761, the entire disclosure of which is incorporated herein by reference in its entirety.

Referring again to FIG. 1, after leaving the fuser assembly 200, a media sheet may be fed via exit rollers into a duplexing path 112 for a duplex print operation on a second surface of the media sheet, or the media sheet may be conveyed by the exit rollers into an output tray.

Figure 3:
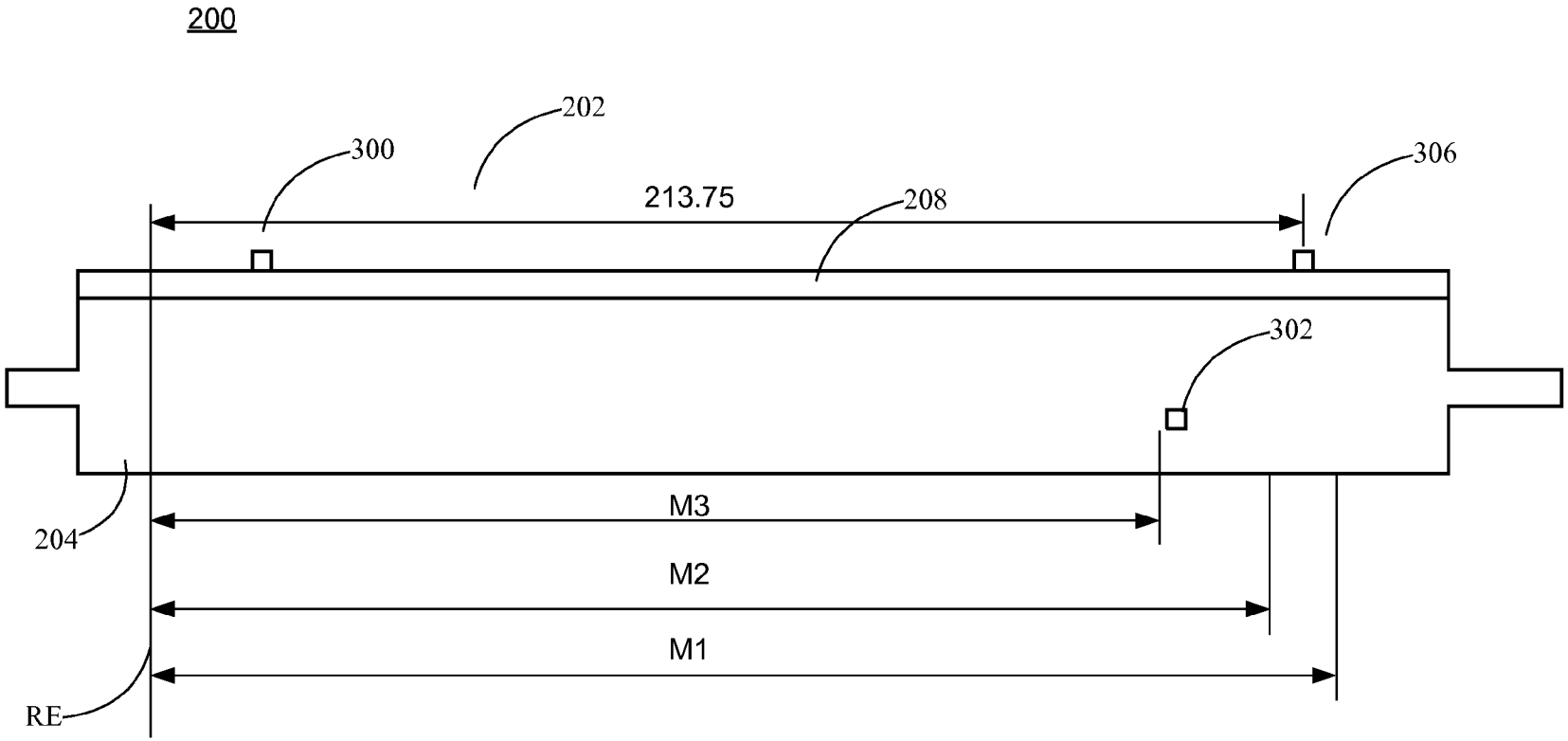
FIG. 3 is a side view of a fuser according to an example embodiment.

With reference to FIG. 3, the fuser assembly 200 may further include a main temperature sensor 300 disposed on or in proximity with the heat transfer member 202; a first temperature sensor 302 disposed on or in proximity with the backup roll 204 for sensing a temperature of a portion thereof; and a second temperature sensor 306 disposed on or in proximity with a distal end region of heater 208 for sensing the temperature of the distal end region thereof. Main temperature sensor 300 and second temperature sensor 306 may be disposed on a surface of the heater 208 opposite a heater surface that contacts an inner surface of the belt 210. Some or all of temperature sensors 300, 302 and 306 may be implemented as thermistors.

In FIG. 3, three different media sheets M1, M2, and M3 having three separate widths are shown relative to reference edge RE. M1 represents full width media and, in the illustrated embodiment, is a Letter-sized media having a width of 8.5 inches or 216 mm. Full width media M1 may include any media having a width greater than 210 mm. M2 represents nearly narrow media and, in the illustrated embodiment, is an A4 media sheet having a width of 210 mm. Nearly narrow media M2 may include any media having a width between about 204 mm and about 213 mm. M3 represents narrow media and, in the illustrated embodiment, is an AS media having a width of 148 mm. Narrow media M3 may include media having a width less than about 203 mm.

As noted above, first temperature sensor 302 senses the temperature of backup roll 204. In the illustrated embodiment, the first temperature sensor 302 may be located at about 203.2 mm from reference edge RE. A portion of the backup roll 204 sensed by first temperature sensor 302 may be seen as an annular, circumferential portion of the backup roll 204 spaced approximately 203.2 mm from the reference edge RE, see FIG. 3. Hence, the portion of the backup roll portion 204 associated with first temperature sensor 302 engages full width M1 media and nearly narrow width M2 media as each moves through the fuser nip during a fusing operation. However, the portion of the backup roll 204 sensed by first temperature sensor 302 does not engage narrow media M3 as such media does not extend sufficiently in a widthwise direction from the reference edge RE. The second temperature sensor 306 may be located about 213.75 mm from the reference edge RE for a 115 volt heater (and about 207.85 mm from the reference edge RE for a 230 volt heater). The location of the second temperature sensor 306 is chosen to detect full width M1 media during a fusing operation.

Based on the temperatures sensed by the first temperature sensor 302 and the second temperature sensor 306, the controller 102 determines whether a media sheet moving along the media path and through the fuser assembly 200 is a full width media M1, nearly narrow media M2, or narrow media M3. For example, if narrow width media sheets are being printed and fused by the image forming apparatus 100, yet the controller 102 has received information from the user indicating that nearly narrow or full width substrates are being processed by the image forming apparatus 100, the portions of the backup roll 204 not contacting and thus not transferring energy in the form of heat to the media sheets may overheat causing degradation of the backup roll 204. Hence, if the controller 102 determines that a media sheet currently being printed is of a size different from the sheet size provided as input to the image forming apparatus 100 by the operator, the controller 102 will use the detected, updated media sheet size information when controlling the image forming apparatus 100.

The controller 102 may sample the first temperature sensor 302 during each fusing cycle at a first point in time after a leading edge of a media sheet passes through the fuser assembly nip and triggers a fuser exit sensor positioned downstream of the fuser assembly nip (not shown). The first point in time amount is based on the thermal response of the backup roll 204 that is related to a default inter-page gap amount and the diameter of the backup roll 204. In one example embodiment, the time delay value is about 150 milliseconds. The controller 102 then samples the first temperature sensor 302 at a second point in time after a trailing edge TE of a media sheet triggers the above-mentioned fuser exit sensor.

Figure 5:
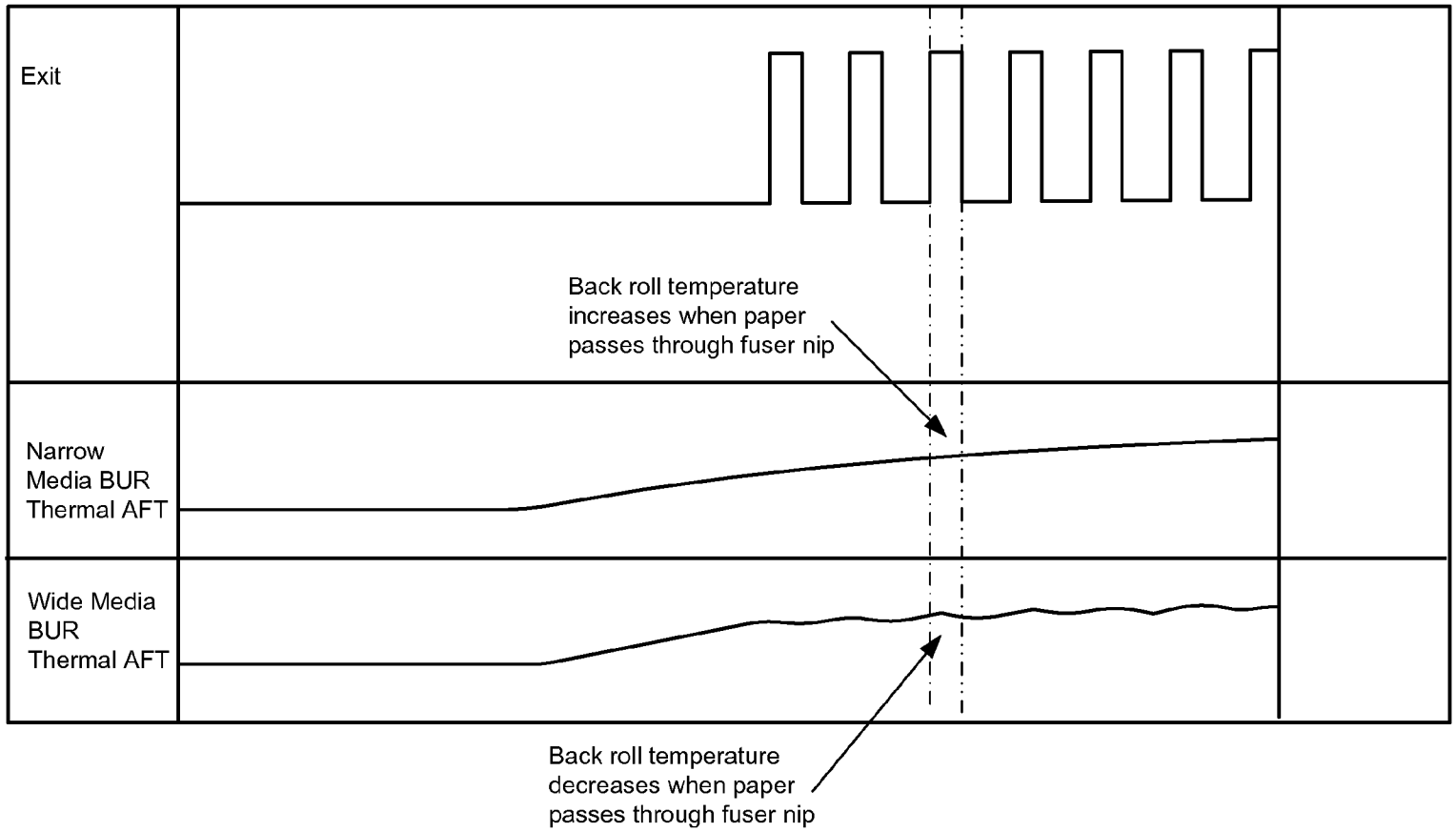
FIG. 5 includes temperature graphs illustrating a method for determining media width.

The controller 102 may take the difference between temperature samples of the first temperature sensor 302 at the first and second points in time and determines that a media sheet is a narrow media M3 if the temperature taken at the second point in time is greater than the temperature taken at the first point in time. The controller 102 further determines that the media sheet is either a full width or a nearly narrow media if the temperature taken at the second point in time is less than the temperature taken at the first point in time. See FIG. 5. A temperature decrease at the second point in time indicates that a media sheet has moved in contact with the area of the backup roll 204 associated with first temperature sensor 302 since energy in the form of heat was transferred from the backup roll 204 to the media sheet. A temperature increase at the second point in time indicates that a media sheet did not contact the area of the backup roll 204 associated with first temperature sensor 302 as heat was not transferred to the media sheet. Instead, the temperature of the backup roll 204 increased. If the temperature at the second point in time is the same as the temperature at the first point in time, the media sheet is assumed to have the same width as that of the immediately preceding media sheet. In one example embodiment, the controller 102 determines that the media sheet is either a full width or a nearly narrow media based on the temperature sensed by the second temperature sensor 306. If the temperature sensed by the second temperature sensor exceeds a first fuser temperature set point T1, the media is determined to be nearly narrow.

To add robustness to the media sheet width detection, the algorithm executed by controller 102 maintains the widths of the most recent media sheets printed. This data may be used to determine the width of the current page being printed. For example, the width of the current media sheet is saved into an array that contains the current history of the page widths. The controller 102 may then count the number of times each width occurred in the history. If the count of a width exceeds a predetermined threshold, the controller 102 will use the width as the current width and will not change the value of the current page's width in the array. The current width may serve as a default current width when controller 102 is unable to determine the width of a media sheet by comparing sensed temperatures at the first and second points in time of a fusing cycle.

Controller 102 executes an algorithm to control media throughput within image forming apparatus 100 based upon sensed temperatures of heater 208 and backup roll 204. In particular, the algorithm executed by controller 102 utilizes fuser temperature set points in controlling media throughput. According to an example embodiment, fuser temperature set points may be grouped in pairs, with each pair of set points T1 and T2 corresponding to a different media width. Fuser temperature set points T1 and T2 are temperature threshold values for fuser heater 208 which when surpassed causes controller 102 to change media throughput in order to avoid possible overheating within the fuser assembly 200. Specifically, the fuser temperature set points T1 and T2 correspond to transient and steady state grease temperatures which if unsurpassed will not cause excessive oil evaporation. A pair of fuser temperature set points may be selected by controller 102 based upon the determined media width. Table 1 illustrates fuser temperature set points for narrow and nearly narrow (and wider) media according to an example embodiment.

TABLE 1

Fuser Temperature Set Point Pairs

| Media | T1 (degrees C.) | T2 (degrees C.) |
|---|---|---|
| Narrow Media | 220 | 200 |
| Nearly Narrow Media | 280 | 220 |

The fuser temperature set point T1 is an empirical value corresponding to a temperature of heater 208 at or below which a predetermined number of sheets of media (for each of narrow and nearly narrow widths) may be printed at a first speed without damaging fuser assembly 200. In an example embodiment, the first speed is the full print speed of the image forming apparatus 100. In the example embodiment, the full speed may be about 70 pages per minute (ppm). The fuser temperature set point T2 is an empirical value corresponding to a temperature of heater 208 at or below which a predetermined number of sheets of media may be printed at a second speed without damaging components of fuser assembly 200. According to the example embodiment, the second speed may be half speed and/or half of the first speed. In the example embodiment, the half speed may be about 35 ppm. In general terms, during a fusing operation the algorithm executed by controller 102 uses temperature set point T1 to determine whether to reduce print speed from the first speed to the second speed, and temperature set point T2 to determine while at the second speed, whether to initially increase the interpage gap between media sheets.

Speed transition control for an imaging device with multiple input-output options is a real consideration not only for improved media throughput but also the user's perception of printer behavior. Different normal or narrow media jobs could wait in a queue for printing. If the speed transition from the device's rated (first) speed to a slower (second) speed and back is too fast, the user may feel that the printer is behaving strangely. On the other hand, if the speed transition takes too long, the printer's throughput could be significantly slower than expected. By using feedback from the first temperature sensor 302 and the second temperature sensor 306, controller 102 can control speed transitions at relatively precisely controlled temperatures for substantially all possible operating conditions. Feedback from first temperature sensor 302 and second temperature sensor 306 makes fuser control more reliable with reduced risk of overheating.

As mentioned, the algorithm performed by controller 102 may initially increase the interpage gap by a gap value when the temperature of the fuser heater 208 reaches or surpasses temperature set point T2. The gap value may be based upon the temperature of backup roll 204 as measured by first temperature sensor 302. Memory associated with controller 102 may store gap values to be selected. A different set of gap values may be maintained in memory for each type of media sheet, thereby forming a table of sets of gap values. In addition, two such tables may be maintained in memory—one table for use during simplex printing and a second table for use in duplex printing. FIG. 4 illustrates the tables of gap values for simplex and duplex printing. As can be seen, each media type has a unique set of gap values corresponding thereto.

For a particular media type or media length, selection may be made from a plurality of gap values. In the example embodiment, selection may be made from five gap values for any media type/length, but it is understood that more or less than five gap values may be used. According to the example embodiment, the selection of a gap value from the plurality of gap values may be made based upon the temperature of backup roll 204 as measured by first temperature sensor 302. Table 2 shows the assignment of gap values to ranges of temperatures of backup roll 204. It is understood that gap values may be assigned to temperature ranges other than the ranges shown in Table 2, and that the gap value sets may have different values therein.

TABLE 2

Gap Value Selection

| BUR Temperature (degrees C.) | Gap Value |
|---|---|
| Less than 160 | Gap 1 |
| 160 < T < 170 | Gap 2 |
| 170 < T < 180 | Gap 3 |
| 180 < T < 185 | Gap 4 |
| 185 < T < 210 | Gap 5 |
| 210 < T | Gap 6 |

Figure 6:
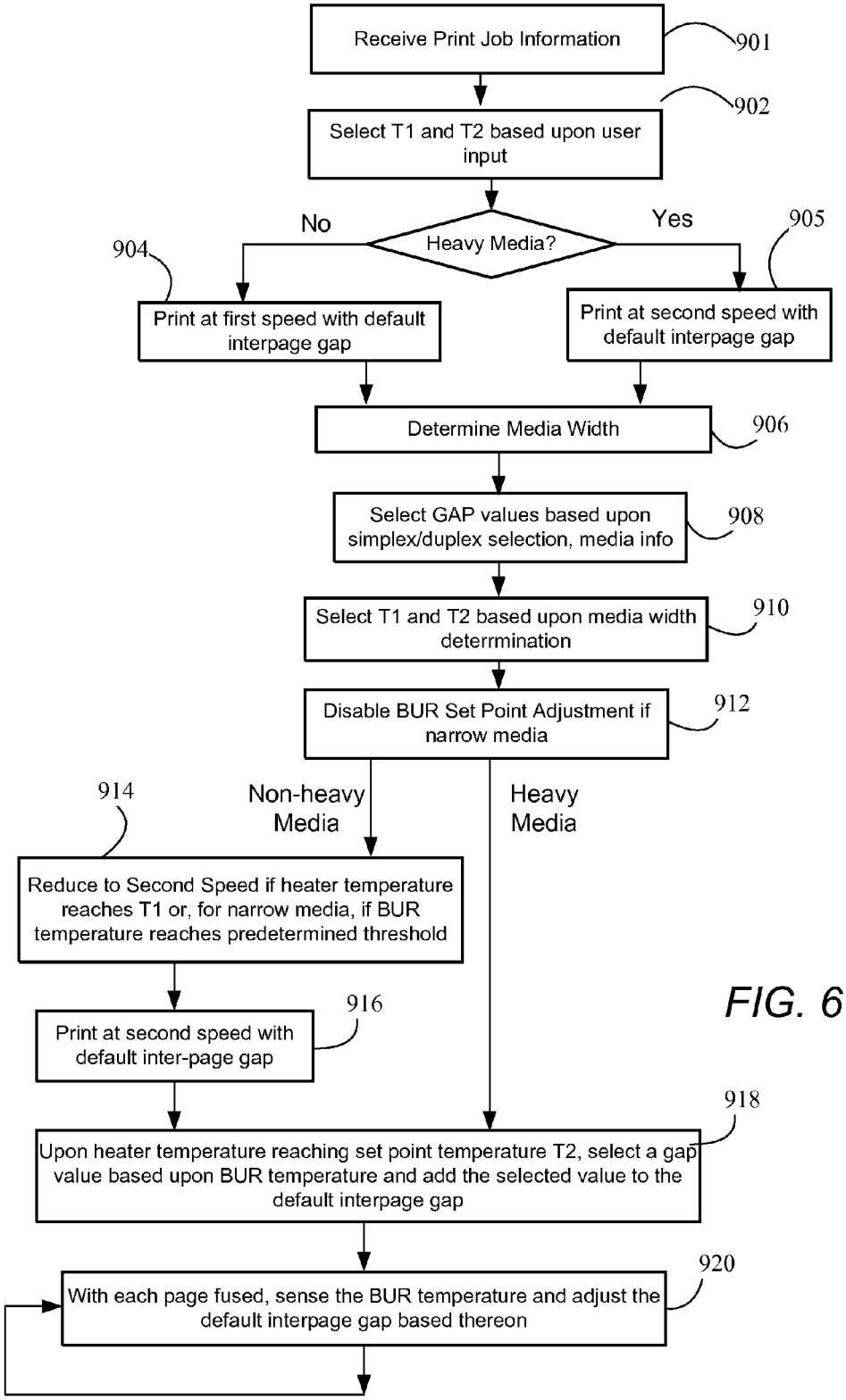
FIG. 6 is a flowchart of a method for improving printer throughput according to an example embodiment.
Figure 7:
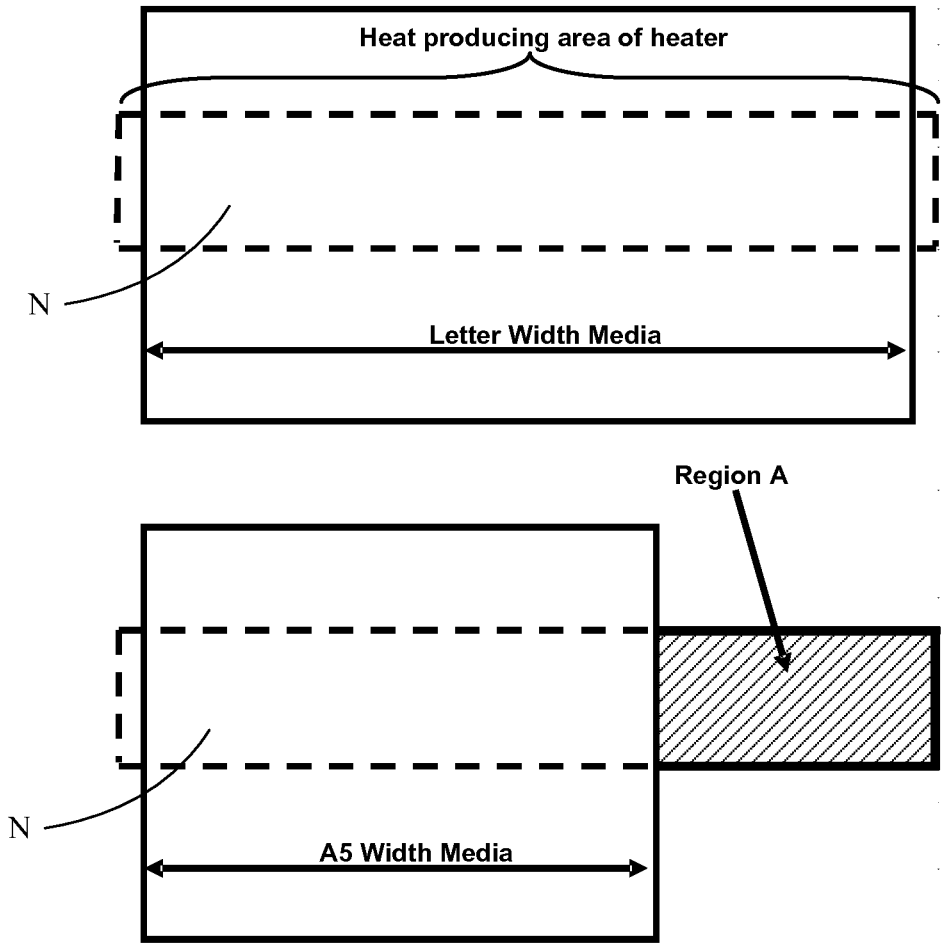
FIG. 7 illustrates an overheating condition when fusing narrow media.

The operation of controller 102 will be described with reference to FIG. 6. As mentioned, the controller 102 may use temperature feedback from the first temperature sensor 302 and the second temperature sensor 306 to improve narrow media throughput by adjusting the printer process speed and the inter-page gap to avoid overheating fuser assembly 200 while maintaining relatively high media throughput levels. For each print job received by the image forming apparatus 100 at 901, the controller 102 first determines, based on operator input, the type, weight, texture and/or size of the media provided in the media tray 104 or any other tray associated with the image forming apparatus 100 storing media to be printed in an upcoming print operation. Based on this operator input information, the controller 102 may select a pair of fuser temperature set points at 902, and set the initial printer process speed at either the first speed (corresponding to full speed) or the second speed (corresponding to half-speed). For example, the controller 102 sets the first speed as the process speed and begins printing at 904 for media that is not considered to be heavy media (hereinafter "non-heavy media") and the second speed (35 ppm) as the process speed and begins printing at 906 for heavy media. The printing may use default interpage gap values in either instance.

As the initial media sheet exits the fuser nip, the controller 102 determines at 906 the width of the media sheet based on temperature feedback from the first temperature sensor 302 at the first and second points in time as explained above. At 908, the gap table may be selected based upon whether the print operation is simplex or duplex and the set of gap values selected therefrom based upon media type, the determined media width, etc. A pair of fuser temperature set points T1, T2 may be selected at 910 based upon the determined media width. For media widths determined to be narrow, controller 102 may disable fuser temperature set point adjustments at 912. Printing of the print job continues at the selected print speed.

For non-heavy media, during continued printing if the temperature of fuser heater 208, as sensed by second temperature sensor 306, reaches or surpasses the fuser temperature set point T1 selected at 910, controller 102 at 914 reduces print speed from the first print speed to the second print speed. This is to prevent the fuser heater 208, the backup roll 204 and/or belt 210 from overheating and being damaged. In the event narrow media is determined at 906, then controller 102 reduces print speed to the second print speed 1) if the temperature of fuser heater 208 reaches or surpasses the fuser temperature set point T1 or 2) if the temperature of backup roll 204 reaches or exceeds a first temperature value, such as 180 degrees C. Thereafter, printing continues at 916 at the second print speed using a default interpage gap value.

As printing continues using non-heavy media at the reduced second print speed, when the temperature of fuser heater 208, as sensed by second temperature sensor 306, reaches or surpasses the selected fuser temperature set point T2, controller 102 at 918 increases the interpage gap by a gap value that is selected based upon the temperature of backup roll 204 as measured by first temperature sensor 302. For example, and referring to Table 2 and the gap tables of FIG. 4, for simplex printing on AS paper, when the temperature of the backup roll 204 is less than 160 degrees C., the gap value selected is 500 ms; when the temperature of the backup roll 204 is greater than 160 degrees C. but less than 170 degrees C., the gap value selected is 900 ms; and when the temperature of the backup roll 204 is greater than 160 degrees C. but less than 170 degrees C., the gap value selected is 1500 ms.

Thereafter, as each page is fused, the controller 102 at 920 monitors the temperature of the backup roll 204 and adjusts the interpage gap accordingly. Specifically, a new gap value is selected from the appropriate gap table in FIG. 4 using the gap value assignments in Table 2, and the new gap value selected is added to the default interpage gap value. By adjusting the interpage gap in this way, the temperature of the fuser assembly 200 is suitably controlled to prevent overheating while simultaneously providing an effective level of media throughput.

For printing on heavy media, printing begins at 905 at the second print speed using a default interpage gap amount. Following execution of acts 906-912 as described above, printing proceeds without controller 102 performing acts 914 and 916 because printing is already at the reduced second print speed. Acts 918 and 920 are performed as described above using the heavy media.

The method described above with respect to FIG. 6 may allow for determining the width of each media sheet passing through fuser assembly 200 or for less than every media sheet, such as at least one sheet per print job.

Upon completing a print job using narrow media, if the next print job is to use media sheets that are not narrow, according to an example embodiment controller 102 will not immediately change back to the first speed from the slower second speed until the following temperature conditions are met: 1) the temperature of backup roll 204, as sensed by first temperature sensor 302, is lower than a predetermined temperature, such as about 140 degrees C.; and 2) the temperature of fuser heater 208, as sensed by the second temperature sensor 306, is less than or equal to the current fuser temperature set point plus about 10 degrees C. In this way, a smoother transition may occur between successive print jobs using different media sheet widths.

In using thermistors for the temperature sensors to detect media that is narrow or nearly narrow, the risk of losing one or both thermistor during the usable life of image forming apparatus 100 is possible. This could be because of an open thermistor or a shorted thermistor error condition. However, instead of raising an error and suspending printing until the defective thermistor is replaced, controller 102 may consider all media as the worst-case, narrow width media and continue printing at the safest print speed and interpage gap allowed. This will allow the customer to be able to print, though at a reduced throughput, until the defective thermistor can be replaced.

The above described system and process for controlling media throughput in image forming apparatus 100 has a number of benefits. First, the algorithm is seen to increase throughput of narrow media. Narrow media throughput is increased due to reliance on sensed temperature values (from first temperature sensor 302 and second temperature sensor 306) instead of a user's media related input such as media weight, width, and length. Based on temperature feedback, controller 102 is able to verify the user's media input and in doing so improve throughput for media with different media length, weight, and width because the media's thermal effects affect the temperature of the non-media portion of fuser assembly 200. Second, the above system and algorithm allows for the elimination of mechanical narrow media sensors, thereby reducing cost.

Third, the system and algorithm reduce the risk of fuser overheating due to not relying on faulty user input. Further, because prior systems may use faulty media input data, a more conservative approach is typically undertaken, thereby leading to reduced throughput control.

Fourth, the above system and algorithm reduce the negative impact on fuser life due to printing on narrow media. In the algorithm, fuser temperature set points T1 and T2 are selected to keep grease temperatures below grease evaporation temperatures during narrow media printing. This reduces the negative impact on friction torque and fuser life. The first predetermined temperature is chosen to maintain the temperature of the non-media portion of backup roll 204 below a predetermined limit in order to limit the increase of the diameter of the non-media portion of the backup roll 204 due to thermal expansion, which could cause an increase of belt traction force, delamination of backup roll 240, and an increase in paper wrinkles due to media speed variation across the width of the media.

Fifth, the above system and algorithm provide improved speed transitions. For narrow media, the print speed transition from the first (rated) speed to the slower second (half) speed and the inter-page gap incrementing are determined by temperatures provided by first temperature sensor 302 and second transfer sensor 306, not by counts of pages like prior art systems. The speed transition from printing on narrow media to printing on normal media print is also based on the temperatures sensed. In this way, the code executed by controller 102 can control speed transition at substantially exactly predetermined temperatures for substantially all operating conditions. It makes fuser control more reliable without risk of overheating.

In the embodiments described above, controller 102 is described as controlling a number of components and assemblies of image forming apparatus 100. It is understood that a number of controllers instead may be used to control the operation of such components and assemblies. Further, the system and algorithm is described above as using full and half speeds as the two printer speeds. It is understood that one or more other printer speeds may be utilized instead, and that more than two printer speeds may be utilized.

Still further, it is understood that more than one first temperature sensor may be used to detect different widths of narrow media. For instance, multiple first temperature sensors 302A and 302B may be used, with each sensor being associated with a distinct pair of fuser temperature set points T1, T2.

While particular embodiments of the present disclosure have been illustrated and described, it would be obvious to those skilled in the art that various other changes and modifications can be made without departing from the spirit and scope of the invention. For example, the media throughput control system and algorithm have been described herein in conjunction with a belt fuser architecture, it is understood the system and algorithm may be used in an imaging device having other fuser architectures, such as a hot roll fuser architecture.

We claim:

1. An imaging apparatus, comprising:

a fuser assembly having a heat transfer member, a backup member positioned to engage the heat transfer member thereby defining a fusing nip therewith, a first temperature sensor associated with the backup member for sensing a temperature of a first portion of the backup member, and a second temperature sensor associated with a distal portion of the heat transfer member for sensing a temperature of the distal portion; and a controller controlling a throughput of media in the imaging apparatus based on the temperature of the first portion of the backup member and the temperature of the distal portion of the heat transfer member.

2. The imaging apparatus of claim 1, wherein the first portion of the backup member is positioned along the backup member for contact by a nearly narrow sheet of media but not by a narrow sheet of media during a fusing operation, and wherein the distal portion of the heat transfer member is positioned along the heat transfer member for contact by a full width sheet of media but not by a nearly narrow sheet of media during the fusing operation.

3. The imaging apparatus of claim 1, wherein the controller is configured to determine whether a media sheet passing through the fuser assembly has a narrow width or nearly narrow width and to selectively identify one or more temperature set points for operating the imaging apparatus based upon the determination.

4. The imaging apparatus of claim 3, wherein the controller is configured to detect a width of each media sheet prior to identifying the one or more temperature set points.

5. The imaging apparatus of claim 3, wherein the controller determines whether the width of the media sheet has a narrow width by sampling a temperature sensed by the first temperature sensor at least twice around a time the media sheet is in the fusing nip and comparing the sampled temperatures to each other.

6. The imaging apparatus of claim 3, wherein the controller, upon detecting a temperature from the second temperature sensor equaling or exceeding a first of the one or more identified temperature set points, causes printing speed to decrease from a first speed to a second speed and media sheets to be printed at the second speed.

7. The imaging apparatus of claim 6, wherein the controller, after causing the printing speed to decrease to the second speed and upon detecting the temperature provided by the second temperature sensor equaling or exceeding a second of the one or more identified temperature set points, selects a gap value and adds the selected gap value to a default interpage gap for defining the interpage gap between successive media sheets.

8. The imaging apparatus of claim 7, wherein the selected gap value is selected from a plurality of gap values based upon a temperature of the backup member as sensed by the first temperature sensor.

9. The imaging apparatus of claim 7, wherein following the selected gap value being added to the default interpage gap, during or after fusing each page the interpage gap is adjusted by selecting a new gap value based upon the temperature of the backup member as sensed by the first temperature sensor and adding the new gap value to the default interpage gap.

10. The imaging apparatus of claim 2, wherein the controller is configured to determine that a sheet of media passing through the fusing nip is a narrow sheet of media based upon the temperature of the first portion of the backup member.

11. The imaging apparatus of claim 5, wherein the controller is configured to detect the width of the media sheet based on a comparison of the sampled temperatures.

12. The imaging apparatus of claim 11, wherein the controller determines the width of the media sheet to be a narrow width if the temperatures sampled by the first temperature sensor increases during the time the media sheet is in the fusing nip, and determines the width of the media sheet to be full or nearly narrow if the temperatures sampled by the first temperature sensor decreases during the time the media sheet is in the fuser nip.

13. The imaging apparatus of claim 1, the heat transfer member including a belt and a heater to heat the belt, wherein the first temperature sensor senses a temperature of a portion of the backup roll which, during fusing operations, contacts a nearly narrow sheet of media but not a narrow sheet of media, and the second temperature sensor senses a temperature of a distal end region which, during the fusing operations, contacts a full width media but not a nearly narrow sheet of media or narrow sheet of media.

14. The imaging apparatus of claim 7, wherein following the selected gap value being added to the default interpage gap, during or after fusing each page the interpage gap is adjusted by selecting a new gap value based upon the temperature of the backup member as sensed by the first temperature sensor and adding the new gap value to the default interpage gap.

15. A printer comprising:

a fuser assembly having:

a heat transfer member including a belt and a heater to heat the belt;

a backup roll positioned to engage the belt thereby defining a fusing nip with the belt;

a first temperature sensor associated with the backup roll for sensing a temperature of a portion of the backup roll which, during fusing operations, contacts a nearly narrow sheet of media but not a narrow sheet of media; and a second temperature sensor associated with a distal end region of the heater for sensing a temperature of the distal end region which, during the fusing operations, contacts a full width media but not a nearly narrow sheet of media or narrow sheet of media; and a controller coupled to the fuser assembly, the controller controlling media sheet throughput through the fuser assembly based on temperatures sensed by the first and second temperature sensors.

16. The printer of claim 15, wherein the controller is configured to detect a width of at least one media sheet by sampling a temperature of the first temperature sensor at least twice during a time the media sheet is in or recently exited from the fusing nip and comparing the sampled temperatures.

17. The printer of claim 16, wherein the controller is configured to select a plurality of temperature set points based upon a detected width of the media sheet, the selected temperature set points being used in controlling the media sheet throughput.

18. The printer of claim 17, wherein the controller, upon detecting a temperature from the second temperature sensor equaling or exceeding a first of the selected temperature set points, causes a speed of the media sheets through the fuser assembly to decrease.

19. The printer of claim 18, wherein the controller, after causing the media sheet speed to decrease and upon detecting that the temperature sensed by the second temperature sensor reaches or surpasses a second of the selected temperature set points, increases an interpage gap between media sheets by a gap value that is based upon the temperature sensed by the first temperature sensor.

20. The printer of claim 19, wherein after the interpage gap is increased, the controller adjusts the interpage gap based upon changes in the temperature sensed by the first temperature sensor.

21. The printer of claim 15, wherein the controller is configured to detect a width of at least one media sheet based on temperatures sensed by the first and second temperature sensors.

22. An imaging apparatus, comprising:

a fuser assembly, including a fuser nip for fusing toner to media sheets and a plurality of temperature sensors, each temperature sensor sensing a temperature at a distinct location in proximity to the fuser nip; and a controller coupled to the fuser assembly, wherein based upon temperatures sensed by the temperature sensors, the controller determines a width of at least one media sheet passing through the fuser assembly and selectively changes media throughput in the imaging apparatus based upon the determined width.

23. The imaging apparatus of claim 22, wherein the controller selects at least one temperature set point based upon the media width determined, the at least one temperature set point identifying a temperature level of a first location of the distinct locations at which the changes to media throughput are initiated.

24. The imaging apparatus of claim 23, wherein the controller causes a decrease in print speed upon a temperature of the first location of the distinct locations reaching or surpassing a first temperature set point.

25. The imaging apparatus of claim 24, wherein when temperature of the first location reaches or surpasses a second temperature set point, the controller causes an increase in an interpage gap between media sheets by a gap value that is based upon a temperature of a second location of the distinct locations, the second location being a location of the fuser nip which contacts nearly narrow media but not narrow media during a fusing operation.

26. The imaging apparatus of claim 25, wherein the interpage gap is thereafter adjusted based upon changes in temperature at the second location of the distinct locations.

27. The imaging apparatus of claim 22, wherein the first portion of the backup member is positioned along the backup member for contact by a nearly narrow sheet of media but not by a narrow sheet of media during a fusing operation, and wherein the distal portion of the heat transfer member is positioned along the heat transfer member for contact by a full width sheet of media but not by a nearly narrow sheet of media during the fusing operation.

28. An imaging apparatus, comprising:

a fuser assembly having a heat transfer member, a backup member positioned to engage the heat transfer member thereby defining a fusing nip therewith, a first temperature sensor associated with the backup member for sensing a temperature of a first portion of the backup member, and a second temperature sensor associated with a distal portion of the heat transfer member for sensing a temperature of the distal portion; and a controller controlling a throughput of media in the imaging apparatus based on at least one of the temperature of the first portion of the backup member and the temperature of the distal portion of the heat transfer member, the controller configured to determine whether a media sheet passing through the fuser assembly has a narrow width or nearly narrow width and to selectively identify one or more temperature set points for operating the imaging apparatus based upon the determination, wherein the controller, upon detecting a temperature from the second temperature sensor equaling or exceeding a first of the one or more identified temperature set points, causes printing speed to decrease from a first speed to a second speed and media sheets to be printed at the second speed, and wherein the controller, after causing the printing speed to decrease to the second speed and upon detecting the temperature provided by the second temperature sensor equaling or exceeding a second of the one or more identified temperature set points, selects a gap value and adds the selected gap value to a default interpage gap for defining the interpage gap between successive media sheets.

29. The imaging apparatus of claim 28, wherein the selected gap value is selected from a plurality of gap values based upon a temperature of the backup member as sensed by the first temperature sensor.

* * * * *